US012523441B2

(12) United States Patent
Olsen et al.

(10) Patent No.: US 12,523,441 B2
(45) Date of Patent: Jan. 13, 2026

(54) ENERGY DISPERSER FOR A FIREARM

(71) Applicant: Killer Innovations, Inc., Tumwater, WA (US)

(72) Inventors: Richard Brady Olsen, Rainier, WA (US); Michael Allyn Miller, Tenino, WA (US)

(73) Assignee: Killer Innovations, Inc., Tumwater, WA (US)

( * ) Notice: Subject to any disclaimer, the term of this patent is extended or adjusted under 35 U.S.C. 154(b) by 0 days.

(21) Appl. No.: 18/784,230

(22) Filed: Jul. 25, 2024

(65) Prior Publication Data

US 2025/0035397 A1 Jan. 30, 2025

Related U.S. Application Data

(60) Provisional application No. 63/516,274, filed on Jul. 28, 2023.

(51) Int. Cl.
*F41A 21/32* (2006.01)
*F41A 21/36* (2006.01)
*F41A 21/34* (2006.01)

(52) U.S. Cl.
CPC ..... *F41A 21/325* (2013.01); *F41A 21/36* (2013.01); *F41A 21/34* (2013.01)

(58) Field of Classification Search
CPC ..... F41A 21/325; F41A 21/36; F41A 21/34
USPC ..... 89/14.3
See application file for complete search history.

(56) References Cited

U.S. PATENT DOCUMENTS 2,165,457 A * 7/1939 Cutts, Jr. ..... F41A 21/36 89/14.3
2,668,479 A * 2/1954 Batten ..... F41A 21/40 89/14.3
2,676,429 A * 4/1954 Gotterson ..... F41A 21/40 89/14.3
2,712,193 A * 7/1955 Mathis ..... F41A 21/42 89/14.3
3,114,289 A * 12/1963 Aulabaugh ..... F41A 21/36 89/14.3
3,138,991 A * 6/1964 Malter ..... F41A 21/46 42/76.01
5,357,842 A * 10/1994 Reynolds ..... F41A 21/36 89/14.3
5,425,298 A * 6/1995 Coburn ..... F41A 21/38 89/14.3
5,433,133 A * 7/1995 La France ..... F41A 21/325 89/14.2
5,463,930 A * 11/1995 Bisping ..... F41A 21/32 89/14.3
7,059,235 B2 * 6/2006 Hanslick ..... F41A 21/38 89/14.3
8,516,941 B1 * 8/2013 Oliver ..... F41A 21/30 89/14.4
9,182,187 B1 * 11/2015 Griffith ..... F41A 21/325
9,441,901 B1 * 9/2016 Harrison ..... F41A 21/36
9,513,078 B1 * 12/2016 Fulton ..... F41A 21/325
(Continued)

*Primary Examiner* — Samir Abdosh
(74) *Attorney, Agent, or Firm* — Eversheds Sutherland (US) LLP

(57) ABSTRACT

A muzzle device with an inner core coupled to the barrel, and an outer sleeve coupled to the inner core. The inner core is sized so that it has a smaller outside diameter than an inside diameter of a gas block fitted to the firearm to which the inner core is to be attached.

19 Claims, 11 Drawing Sheets

(56) References Cited

U.S. PATENT DOCUMENTS

| | | | | |
|---|---|---|---|---|
| 10,612,878 | B1 * | 4/2020 | Salvador | F41A 21/325 |
| 11,397,066 | B1 * | 7/2022 | Oglesby | F41A 21/325 |
| 11,549,774 | B2 * | 1/2023 | Shane | F41A 3/66 |
| 2015/0253098 | A1 * | 9/2015 | Russell | F41A 21/30 89/14.4 |
| 2016/0209152 | A1 * | 7/2016 | Dueck | F41A 21/30 |
| 2016/0377372 | A1 * | 12/2016 | Hodgson | F41G 1/32 42/1.06 |
| 2023/0358495 | A1 * | 11/2023 | Griffitts | F41A 21/30 |

* cited by examiner

ENERGY DISPERSER FOR A FIREARM

RELATED APPLICATIONS

This application is related to, and claims the benefit of, U.S. Provisional Patent Application No. 63/516,274, filed Jul. 28, 2023, the entire contents of which are incorporated herein by reference.

FIELD OF THE INVENTION

The present disclosed concept relates to firearms. The present disclosed concept also relates to energy dispersers, such as muzzle devices or flash hiders, for firearms.

BACKGROUND OF THE INVENTION

Firearms, such as semi-automatic rifles (e.g., without limitation, M16s), typically have a barrel, rear and front sights, a gas block and a gas tube that are each coupled to the barrel, and a muzzle device, flash hider, or the like, coupled to an end of the barrel so that when a bullet exits the barrel, the gases exiting the barrel are redirected to reduce felt recoil and muzzle lift, in the case of a brake and/or compensator, or to disperse the burning gases exiting the barrel so as to reduce muzzle flash, in the case of a flash hider.

Known semi-automatic rifles often have barrels that are cut to less than 16 inches, and have muzzle devices (e.g., or flash hiders, or similar apparatus) connected via a pin and weld to the ends of the shortened barrels, so that the resulting total length is at least 16 inches, thus eliminating the resulting barrel will not be subject of the National Firearms Act of 1934. A known drawback of such firearms is that gas blocks and barrel nuts cannot be removed from the barrels because the outer diameter of, for example, the muzzle device or flash hider, is greater than the inner diameter of the gas block and/or the barrel nut. It is with respect to these and other disadvantages that the instant disclosure is concerned.

DESCRIPTION OF THE DRAWINGS

The detailed description is set forth with reference to the accompanying drawings. The use of the same reference numerals indicates similar or identical components or elements; however, different reference numerals may be used as well to indicate components or elements which may be similar or identical. Various embodiments of the disclosure may utilize elements and/or components other than those illustrated in the drawings, and some elements and/or components may not be present in various embodiments. Depending on the context, singular terminology used to describe an element or a component may encompass a plural number of such elements or components and vice versa.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

As employed herein, the term "coupled" shall mean connected together either directly or via one or more intermediate parts or components.

Figure 1:
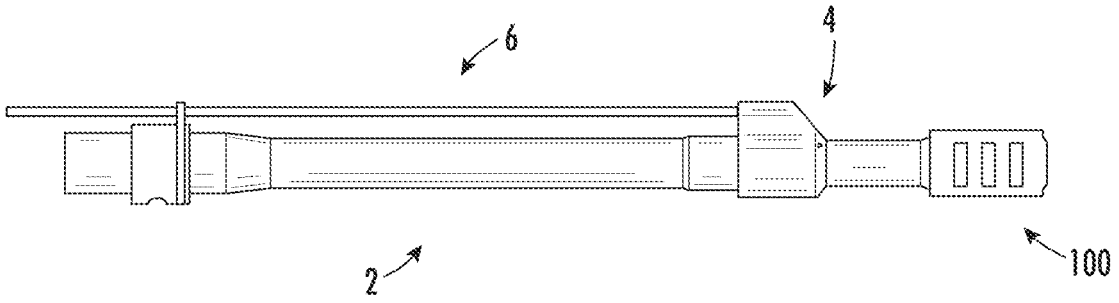
FIG. 1 shows a firearm, in accordance with one non-limiting embodiment of the disclosed concept.
Figure 2:
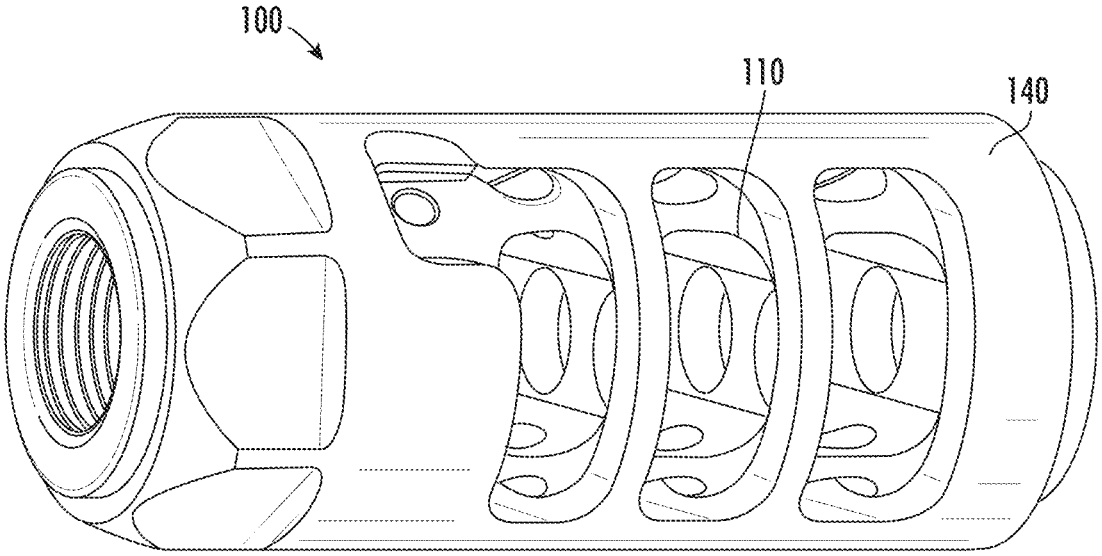
FIGS. 2-8 show different views of a muzzle device for the firearm of FIG. 1.
Figure 3:
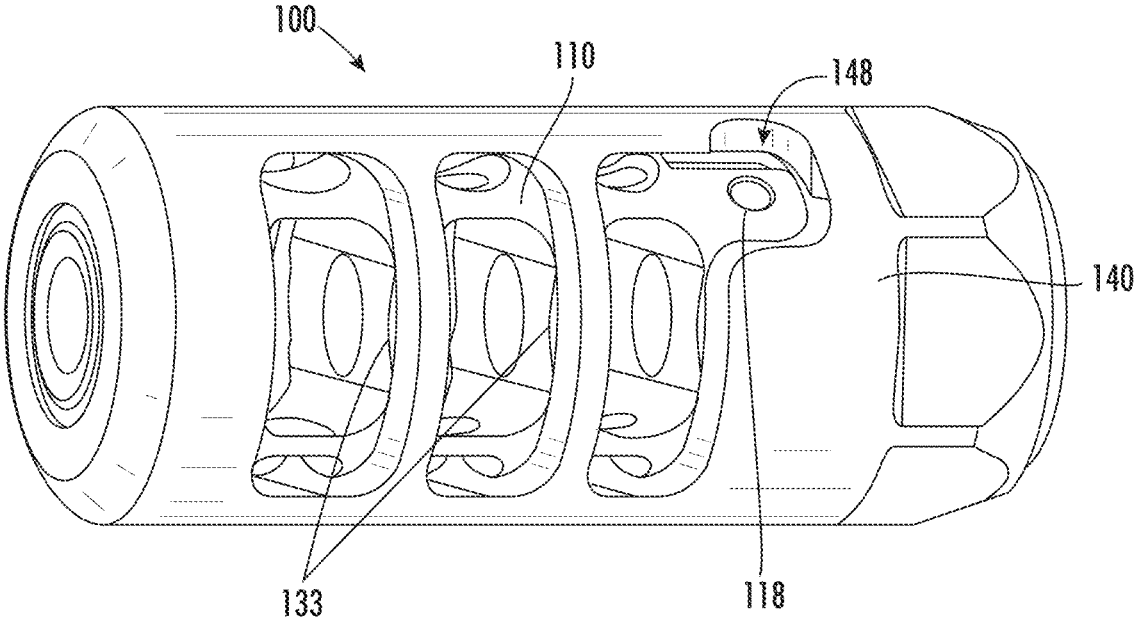
Figure 4:
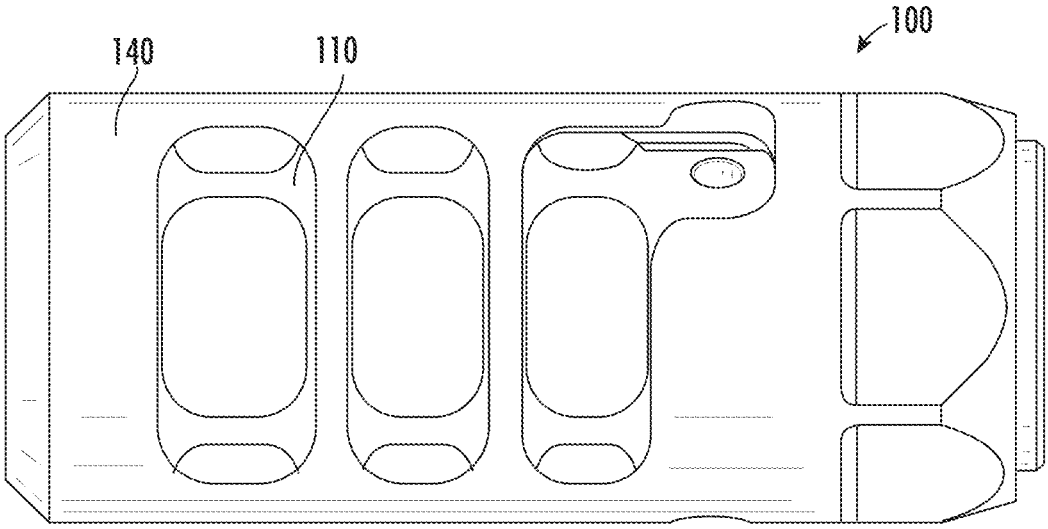
Figure 5:
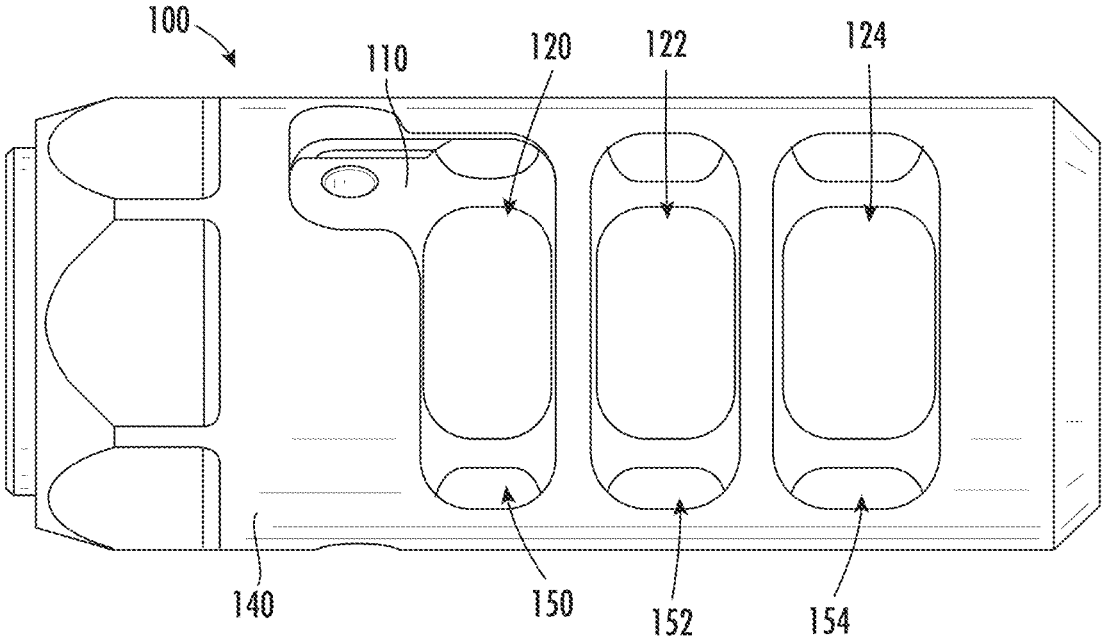
Figure 6:
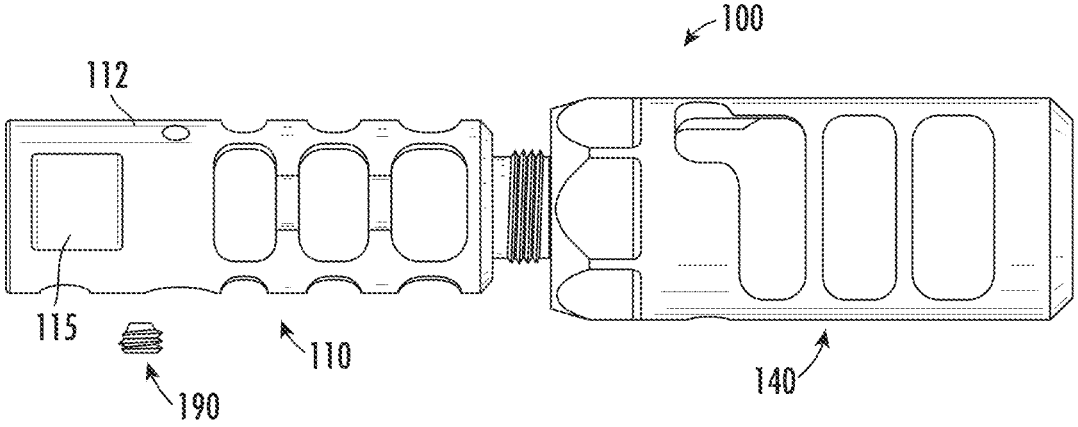

FIG. 1 is an isometric view of a barrel and gas system of a firearm (e.g., without limitation, a semi-automatic or fully automatic rifle), in accordance with one non-limiting embodiment of the disclosed concept. As shown, the barrel 2 includes a gas block 4, to which a gas tube 6 is coupled. Additionally, in accordance with the disclosed concept, the barrel 2 further includes an energy disperser (e.g., without limitation, muzzle device 100) coupled to an end of the barrel 2 and configured to redirect burning gases exiting the barrel 2 to mitigate felt recoil at the firing of the rifle and/or to mitigate muzzle lift of the rifle. Moreover, as will be discussed below, the muzzle device 100, as compared to prior art brakes/compensators devices and flash hiders (not shown), advantageously allows for the gas block 4 and a barrel nut (not shown) to be removed from the barrel 2 even if the muzzle device 100 has been pinned and welded to the barrel 2. This is advantageous, as compared to prior art firearms (not shown), which typically do not allow for removal of these components in a simple manner, if at all.

In order to realize the abovementioned benefits, the muzzle device 100, as shown in FIGS. 2-8, includes an inner core 110 and an outer sleeve 140 coupled to and located externally with respect to the inner core 110. The inner core 110 may have an outside diameter of, for example, 0.75 inches or less so that the gas block 4 can slide over it for removal while the inner core 110 may be permanently attached to the barrel 2. The addition of the fitted outer sleeve 140 is configured to have an inner diameter only slightly larger than the outer diameter of the inner core 110, such as, for example, 0.751 inches, which when installed over the inner core 110 provides for more port surface area than found in a 0.75 inch muzzle device, making it more efficient in redirecting exhaust gases to, for example, reduce recoil and muzzle lift. The difference between the outside diameter of the inner core and the inside diameter of the outer sleeve may be less than 0.1 inches, including approximately between 0.00001 and 0.1 inches, or in some cases between 0.001 and 0.01 inches. The tighter the fit the less carbon build up may occur between the inner core and outer sleeve, making removal of the outer sleeve 140 easier.

The outside diameter of the inner core may vary based on the barrel to which it is attached, particularly the diameter of the barrel to which it is to be attached at the point where the gas block attaches to the barrel. The outer diameter of the inner core is preferably no larger than the barrel at that point to ensure the gas block can be removed over the inner core. Stated differently, the inner core outside diameter is no larger than any gas block or apparatus that could be installed on the barrel or that slides over the barrel behind the inner core 110 on the barrel. For example, while the dimension above are generally applicable to a barrel for a 0.223/5.56 round, other common gas block inside diameters include 0.625 inches and 0.936 inches.

Figure 11:
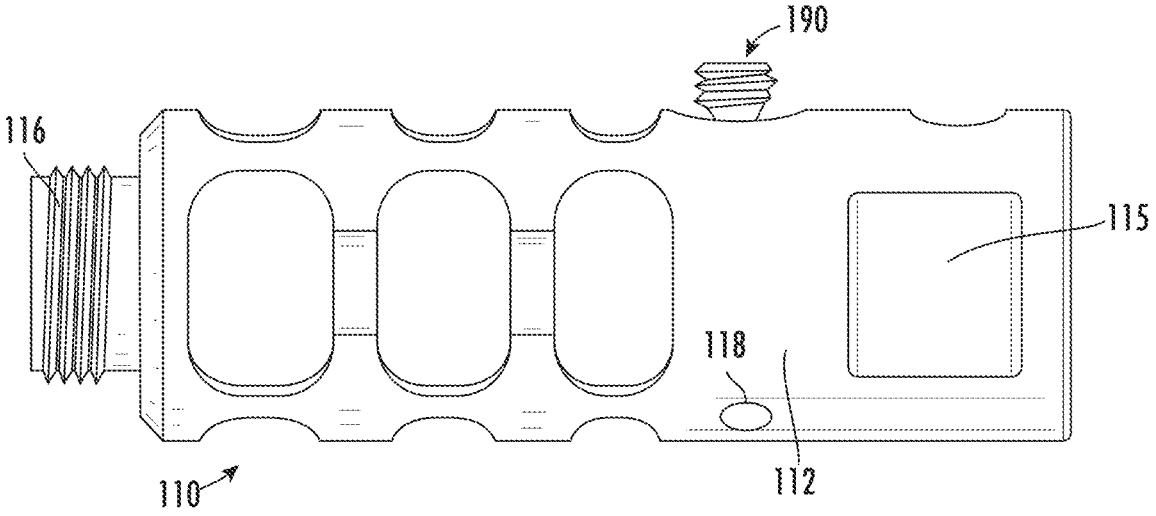
Figure 12:
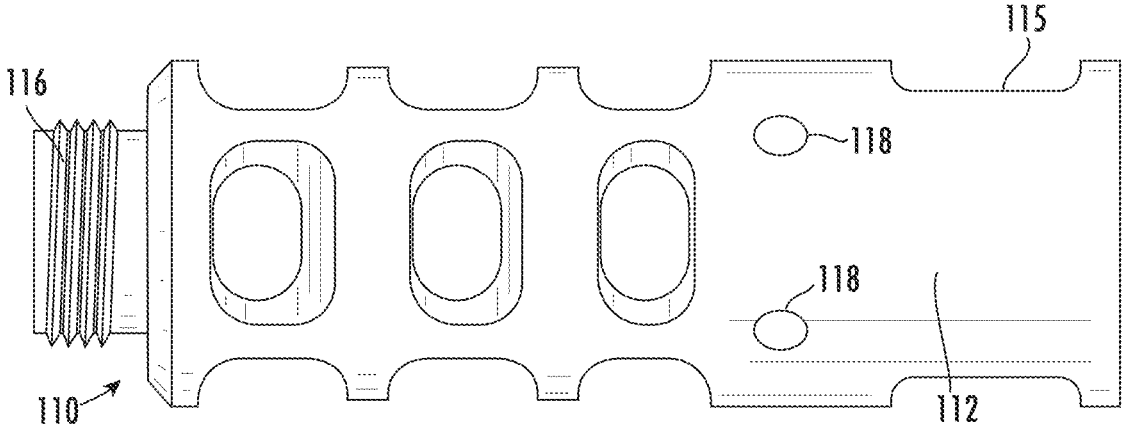
Figure 13:
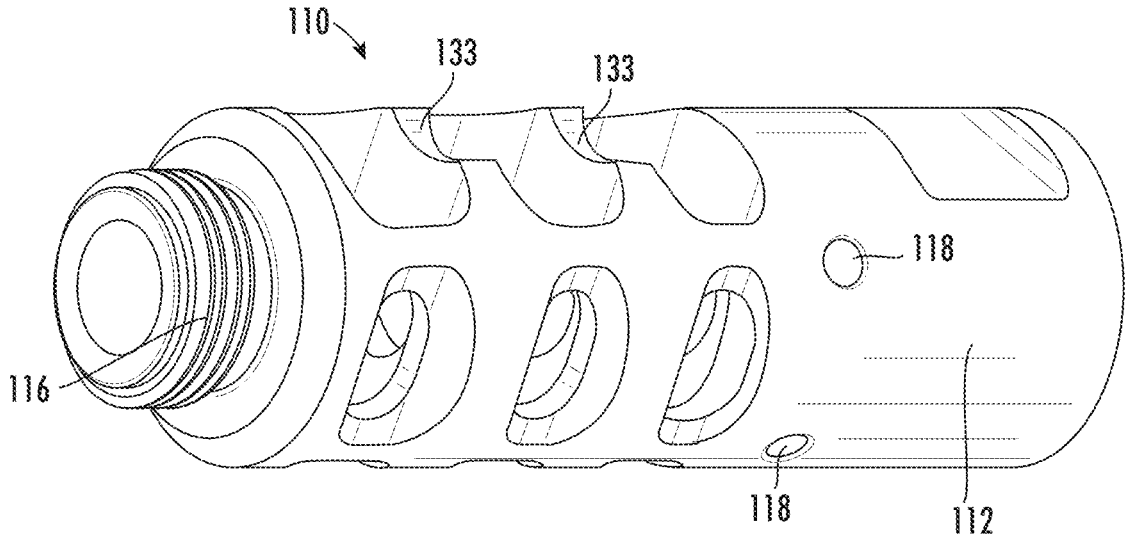
Figure 14:
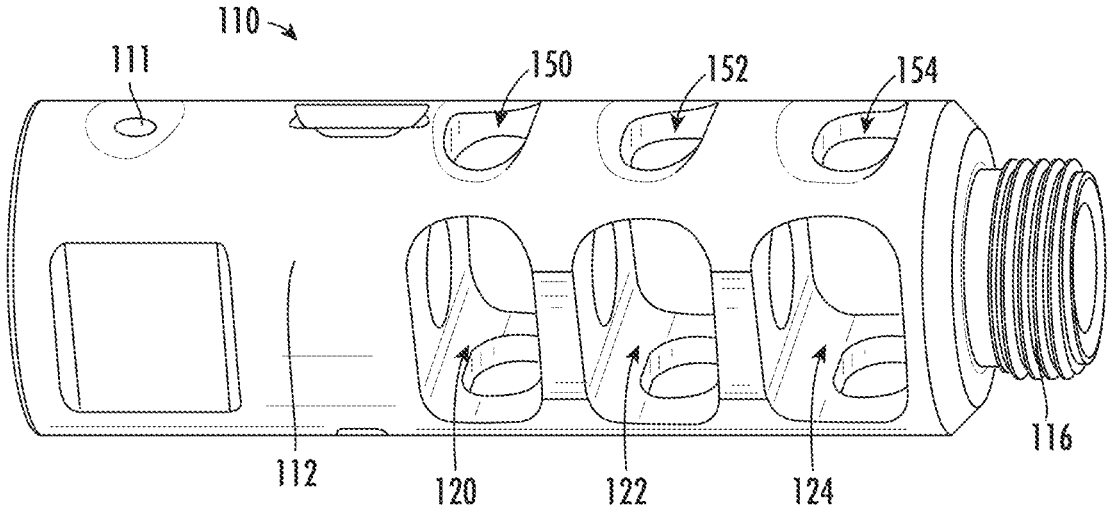
Figure 15:
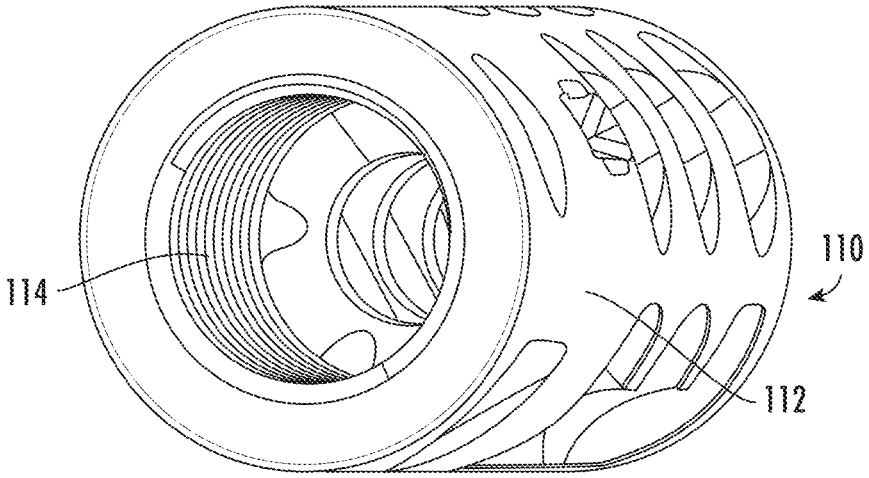

In one example, the inner core 110 is coupled to the end of the barrel 2. During installation on a rifle, for example, the inner core 110 may first be threaded onto the end of the barrel 2, and then fixedly coupled to the end of the barrel 2 via a pin and weld connection. When the inner core 110 is being threaded onto the barrel 2 of a rifle, planar faces 115 (FIGS. 6, 9, and 11) of the inner core 110 may be gripped by a tool (e.g., a wrench) in order to allow for firm tightening. Subsequently, once the inner core 110 is tightened onto the barrel 2 in with the desired timing, a pin (not shown) may be inserted through the inner core 110, such as through a thru hole 111 (FIG. 8) in the inner core 110, where the pin may be partially received in a corresponding recess or hole in the barrel 2, at which point the pin may be welded via solder, thereby fixedly coupling the inner core 110 directly to the end of the barrel 2, as is well known. Additionally, as shown, the thru hole 111 is defined by a grooved region (e.g., a surface that is concave facing away from an interior of the inner core 110 in order to allow the solder to fill in the grooved region and not protrude beyond the outer diameter of the inner core 110 so as not to obstruct the removal of a gas block or barrel nut from the barrel 2. In other embodiments, the inner core 110 may be secured to the outer sleeve by other suitable methods, such as a pin or running jam nut on the back of the outer sleeve.

In one example embodiment of the disclosed concept, the inner core 110 has a maximum outer diameter that is less than a minimum inner diameter of each of the gas block 4 (FIG. 1) and the barrel nut (FIG. 1). In this manner, with the inner core 110 fixedly coupled to the end of the barrel 2, as discussed above, the gas block 4 (FIG. 1) and the barrel nut (FIG. 1) can readily be removed from the end of the barrel 2, e.g., slid off.

Figure 19:
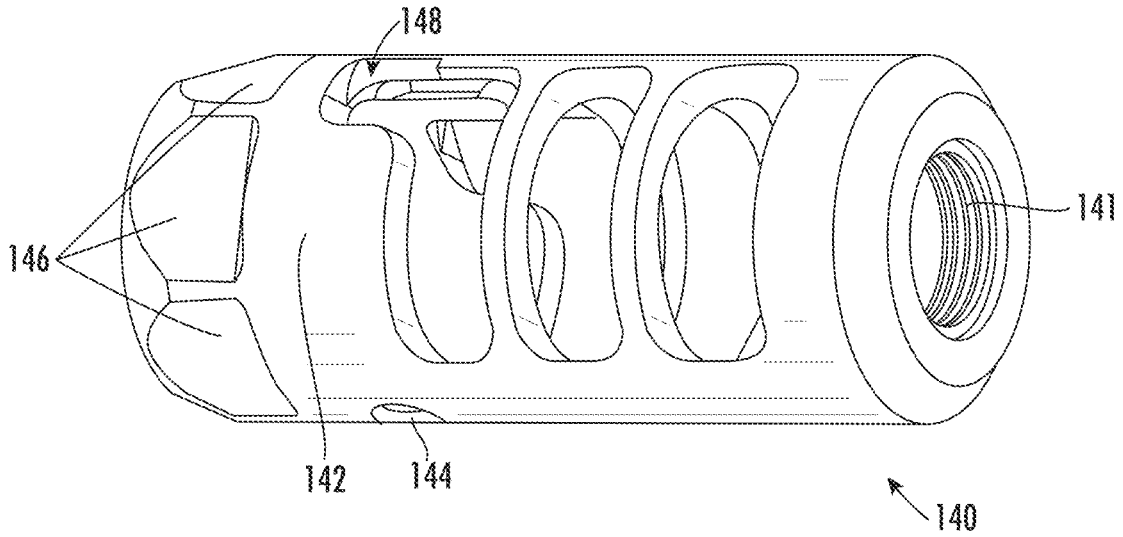
Figure 20:
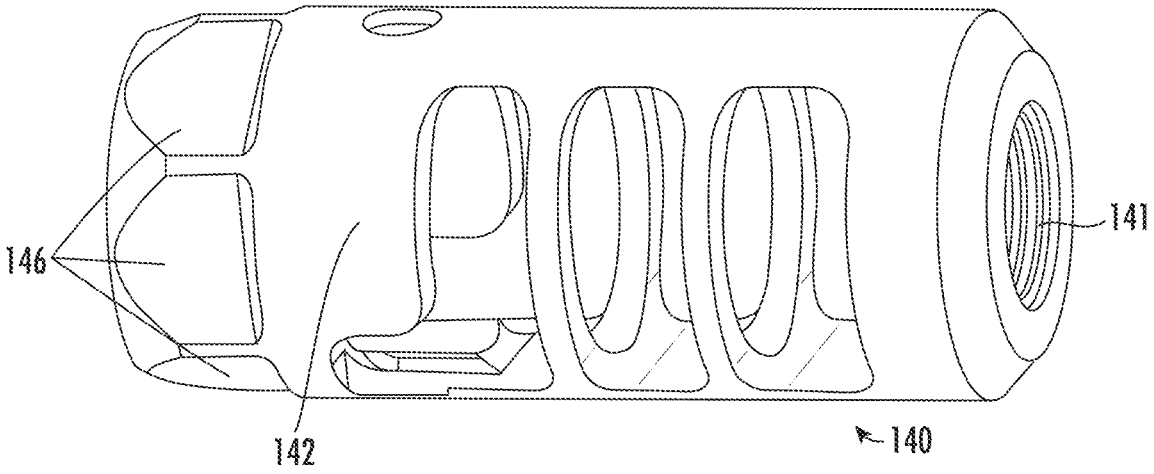

In addition to allowing the gas block 4 (FIG. 1) and the barrel nut (FIG. 1) to be easily slid off of the barrel 2 (FIG. 1), the inner core 110, as shown in FIGS. 6-16, includes a body 112 having a number of internal threads 114 (FIG. 15) at a first end, and a number of external threads 116 at a second end opposite the first end. In one example, the internal threads 114 advantageously allow the inner core 110 to be threadably coupled to a corresponding externally threaded portion at the end of the barrel 2, and the external threads 116 allow the outer sleeve 140 to be removably coupled to the inner core 110 via internal threads 141 (FIGS. 19 and 20) of the outer sleeve 140. With the outer sleeve 140 coupled to the inner core 110, desirable dispersing of gases exiting the end of the barrel 2 during firing of the rifle can advantageously be achieved, as will be discussed below. Additionally, because the outer sleeve 140 is removably coupled to the inner core 110, removal of the gas block 4 and the barrel nut from the barrel 2 can be achieved via simple de-coupling of the outer sleeve 140 from the inner core 110 and sliding of these components off of the end of the barrel 2.

Figure 8:
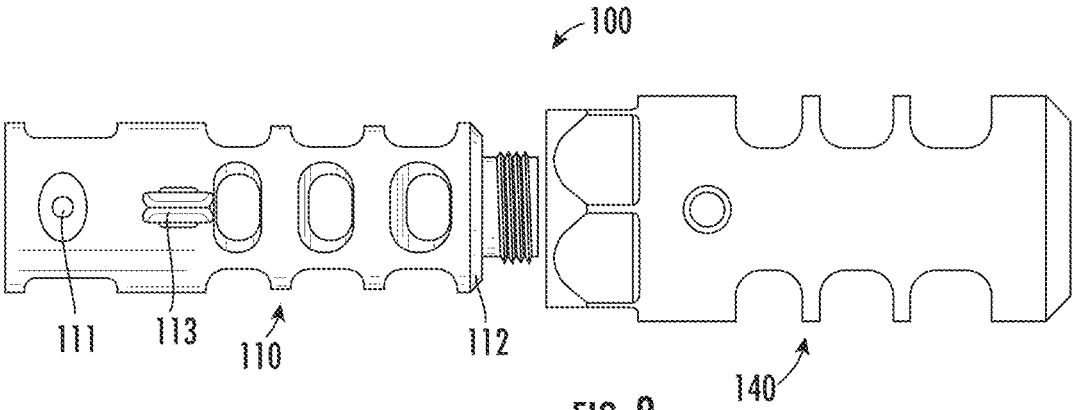
Figure 9:
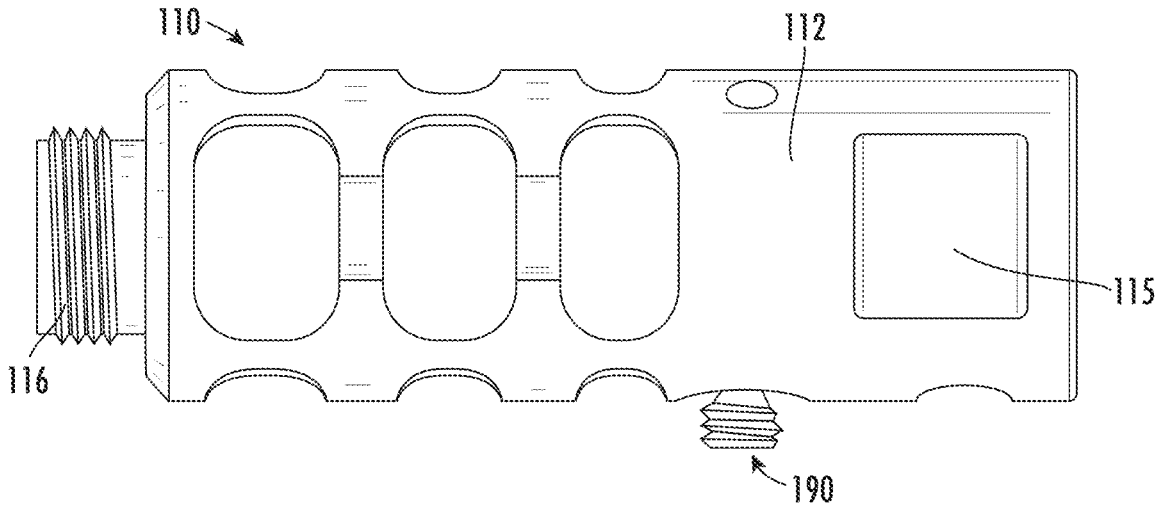
FIGS. 9-16 show different views of an inner core for the muzzle device of FIGS. 2-8, with FIGS. 9-11 also showing a set screw of the muzzle device.
Figure 10:
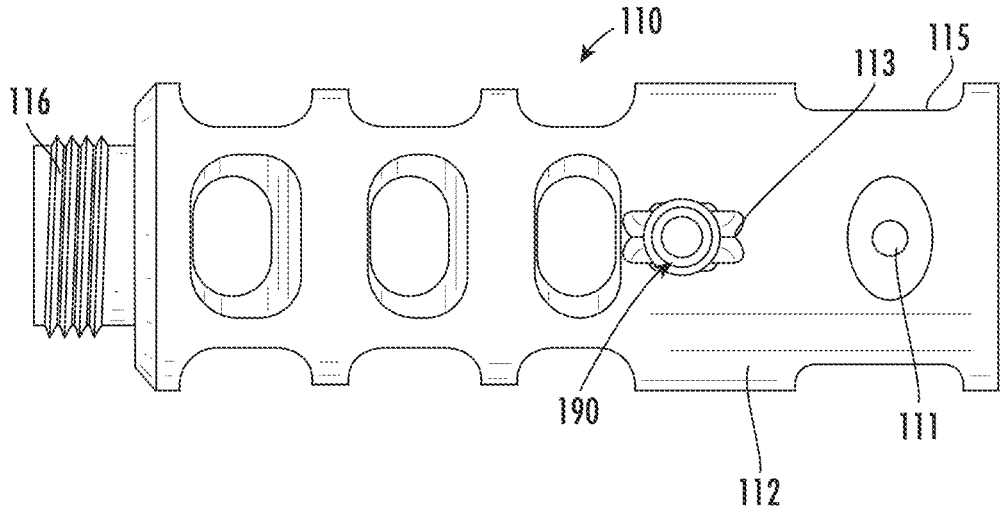
Figure 17:
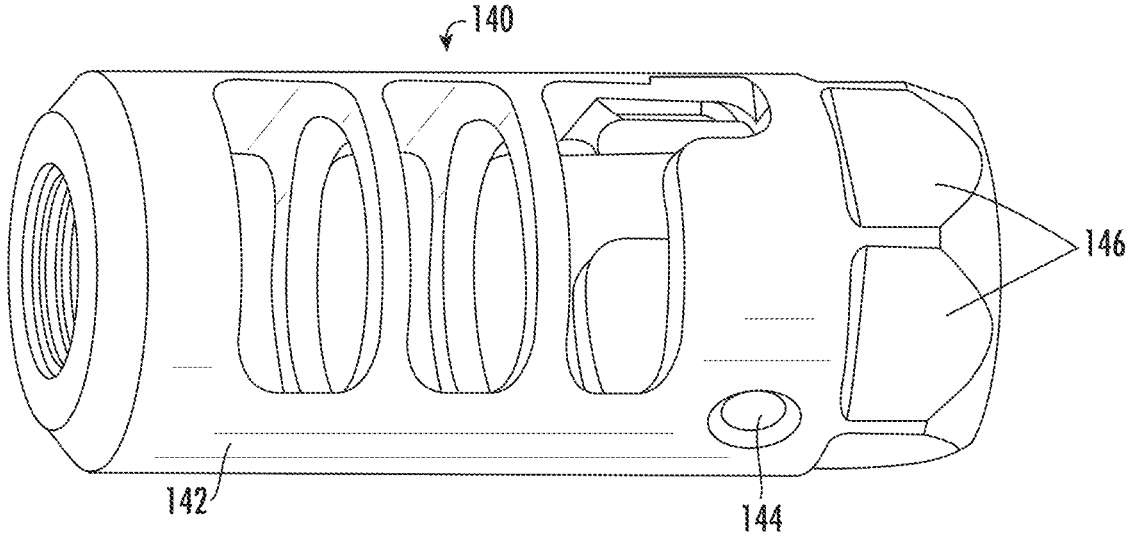
FIGS. 17-20 show different views of an outer sleeve for the muzzle device of FIGS. 2-8.
Figure 18:
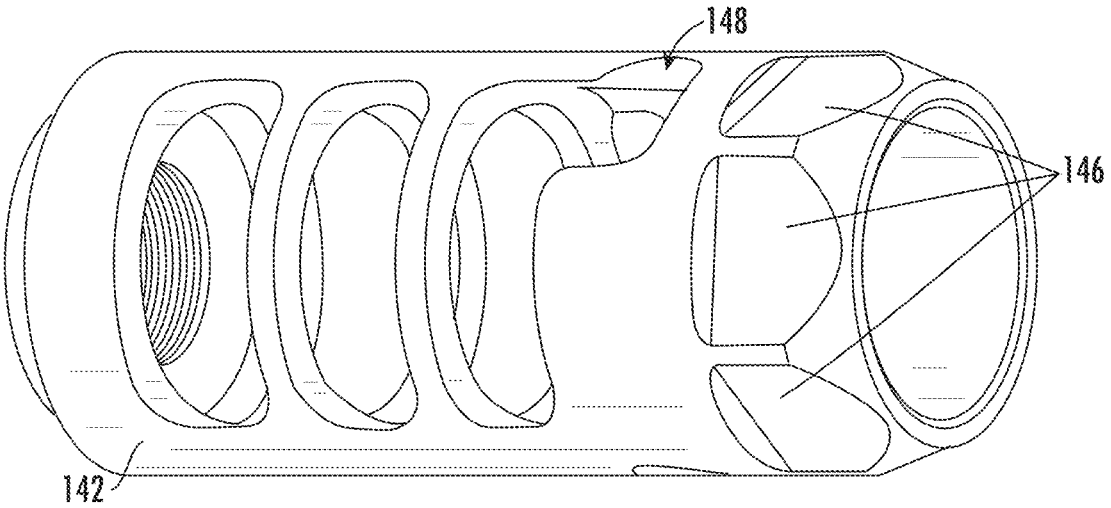
Figure 21:
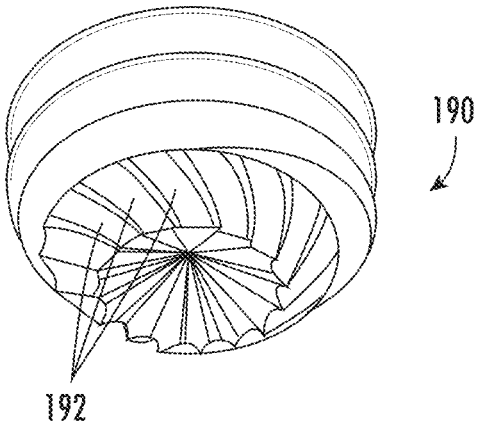
FIGS. 21-23 show different views of a set screw for the muzzle device of FIGS. 2-8.
Figure 22:
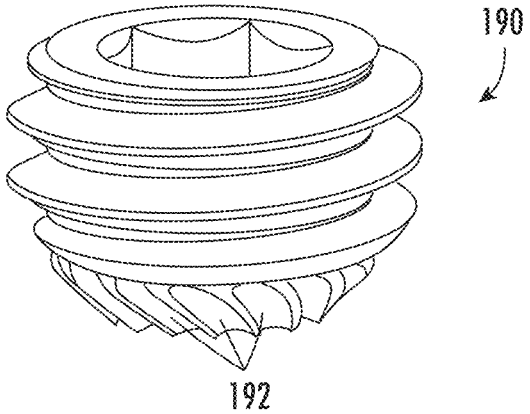
Figure 23:
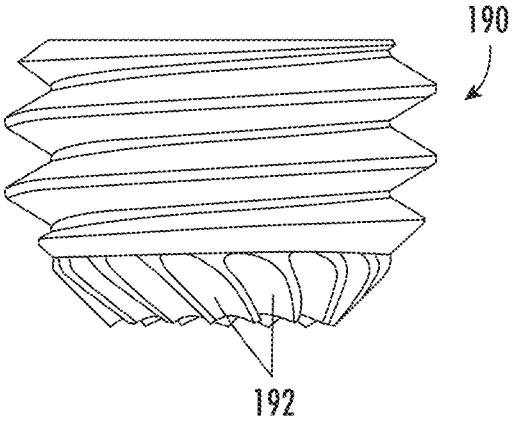

As stated, the outer sleeve 140 is removably coupled to the inner core 110. In order to couple the outer sleeve 140 to and de-couple the outer sleeve 140 from, the inner core 110, the muzzle device 100 further includes a set screw 190. Furthermore, the outer sleeve 140 comprises a body 142 (FIGS. 17-20) having a threaded thru hole 144 (FIGS. 17 and 19), and the body 112 of the inner core 110 has a V-shaped groove 113 (FIGS. 8 and 10). In one example, the outer sleeve 140 is fully threaded onto the inner core 110 such that complete rotation (e.g., until the two components are fully mated via threads) aligns the thru hole 144 of the outer sleeve 140 with the V-shaped groove 113 of the inner core 110. When the outer sleeve 140 reaches this point, the set screw 190 may be inserted into the threaded thru hole 144 and tightened by a user such that these components 110 and 140 are securely coupled together. Additionally, as shown in FIGS. 21-23, the set screw 190 preferably has a plurality of grooves 192 on a bottom engaging surface thereof, and these grooves 192 are structured to cut and/or bite into the V-shaped groove 113 of the inner core 110 in order to minimize the likelihood that the set screw 190 will become dislodged. In addition, the use of a V-shaped groove 113 minimizes the metal shards and splinters from the engagement of the set screw 190 in the V-shaped groove 113 that might otherwise interfere with the installation and removal of the outer sleeve 140 to the inner core 110. Accordingly, this is an improvement over prior art arrangements (not shown), wherein oftentimes any number of washers will have to be employed to properly align a muzzle device onto a barrel each time the muzzle device is removed and reinstalled. Thus, once the inner core 110 is installed on the barrel 2, the removal and reassembly of the outer sleeve 140 to the inner core 110 are greatly streamlined, for example, when one wants to remove the gas block, due to the two part construction of the muzzle device 100 and the improved timing caused by the set screw 190 and V-groove 113 configuration.

The disclosed concept also provides that the outer sleeve 140 is reverse threaded onto the inner core 110. This may be done so that when the two components 110 and 140 are fully coupled but not pinned and welded together, and a user desires to remove the outer sleeve 140 (e.g., so that the gas block 4 can be slid off of the barrel 2), rotation of the outer sleeve 140 will not rotate the inner core 110 off of the barrel 2. More specifically, when a user begins to rotate the outer sleeve 140 off of the inner core 110, the reverse threading will cause the inner core to press toward a tightened position (e.g., not a loosened or de-coupling position). This is desirable because relatively large amounts of torque will generally be needed to twist the outer sleeve 140 off of the inner core 110 (e.g., after the set screw 190 has been removed from the outer sleeve 140), for example because of carbon build up between these components 110 and 140. Accordingly, in one example the outer sleeve 140 is left hand threaded onto the inner core 110, and the inner core 110 is right hand threaded onto the barrel 2. However, it will be appreciated that the reverse arrangement is also contemplated, e.g., wherein an outer sleeve is right hand threaded, and an inner core is left hand threaded.

Figure 7:
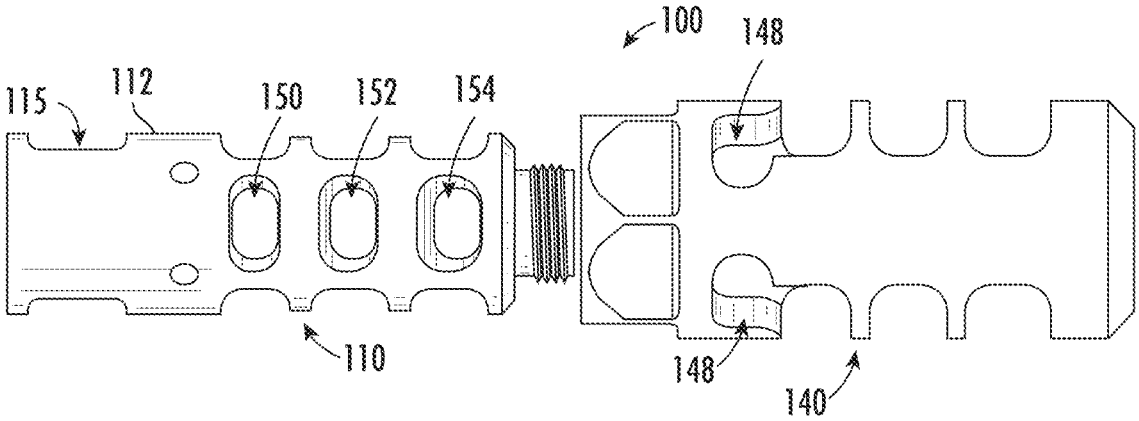

Referring to FIGS. 17-20, the body 142 of the outer sleeve 140 has a plurality (e.g., without limitation, six) of planar faces 146 that are structured to allow a tool (e.g., a wrench, not shown) to firmly grip and apply necessary torque for coupling. Moreover, both the inner core 110 and the outer sleeve 140 are desirably structured to counter muzzle lift that would otherwise occur during firing of a rifle. More specifically, as shown in FIG. 7, the body 112 of the inner core 110 further includes a number (e.g., two) of thru holes 118 (labeled in FIG. 13), and the body 142 of the outer sleeve 140 has a corresponding number (e.g., two) of cutout regions 148 (labeled in FIGS. 18 and 19) aligned with the thru holes 118. See also FIG. 3, for example, to appreciate the alignment between the thru holes 118 and the cutout regions 148. It will be appreciated that the thru holes 118 and the cutout regions 148 are positioned to point up, that is, relative to a top of the barrel 2, wherein a bottom of the barrel 2 corresponds to being located proximate a "trigger side" of a rifle. In this manner, when a user fires the rifle and the projectile exits the barrel 2, the thru holes 118 and the cutout regions 148 will provide a pathway for gases to exit up, and thus mitigate lift at the end of the barrel 2. That is, gases may pass through the thru holes 118 of the inner core 110 and then directly through the cutout regions 148 of the outer sleeve 140 because the holes 118 and the cutout regions 148 provide a direct pathway therethrough for gases.

In the same manner, both the inner core 110 has a corresponding plurality of pairs of ports 120, 122, and 124 and 150, 152, and 154 (labeled in FIGS. 5 and 14) and the outer sleeve 140 has ports 160, 162, and 164 that are structured to counteract recoil of the rifle during firing. As shown most clearly in FIG. 5, the pairs of ports 120, 122, and 124 of the inner core 110 are aligned with (e.g., provide a direct pathway therethrough) the pairs of ports 160, 162, and 164 of the outer sleeve 140 when the inner core 110 is coupled to the outer sleeve 140 such that a direct pathway is provided for gases to pass through the muzzle device 100. However, in one example (not shown) the ports 120, 122, and 124 are not aligned with the ports 160, 162, and 164 when the two components 110 and 140 are coupled together. In yet a further example, a flash hider (not shown) may be employed with the inner core 110 instead of the outer sleeve 140 to comprise a different energy disperser than the example muzzle device 100. Further, the outer sleeve 140 may have a second thru hole 144 and/or the inner core 110 may have a second v-shaped groove 113 to provide a second or different alignment of the inner core 110 to the outer sleeve 140 to, for instance, close off or open up holes 118 and/or additional holes 118, or to create a different configuration/alignment of ports 120, 122, and 124 and 160, 162, and 164. Additionally, as shown, the port 160 of the outer sleeve 140 coincides with the cutout regions 148 of the outer sleeve 140 such that one continuous cutout region in the wall of the outer sleeve 140 is provided.

In one example, the inner core 110 further includes a plurality of pairs of additional ports 150, 152, and 154, as shown most clearly in FIG. 7. As shown, the ports 150, 152, and 154 are each beveled, and the beveling progressively increases from the first pair ports 150 to the third pair of ports 154, while the size of the thru holes defined by each of the pair of ports 150, 152, and 154 is the same for all of the ports 150, 152, and 154, in one example. This may be because the first of the pair ports 150 is structured to do a large portion (e.g., 90 percent) of the breaking up or redirecting of exhaust gases, as compared to the other ports 152 and 154.

Figure 16:
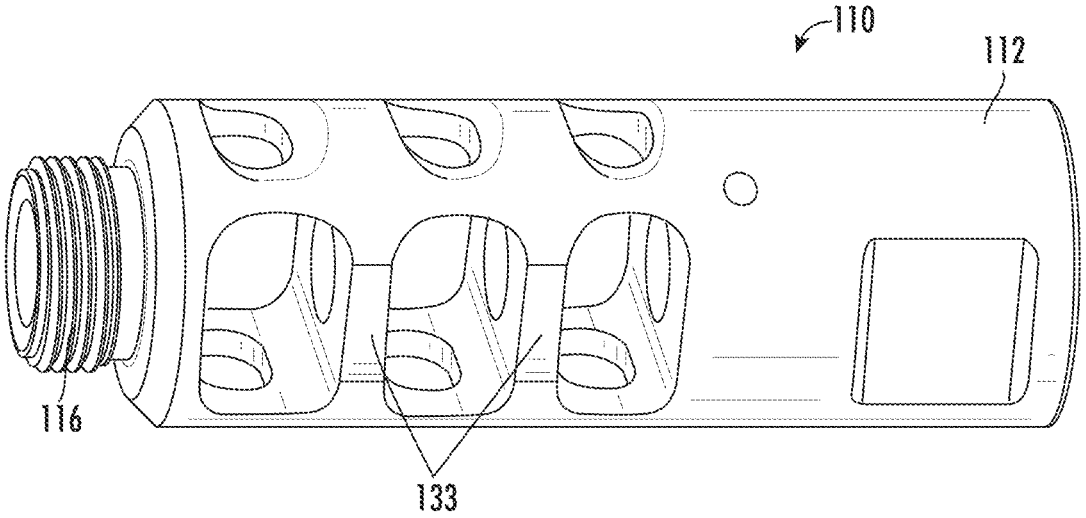

In addition to the aforementioned ports and cutout regions, the inner core 110 may have a number of pairs of inwardly extending grooved regions 133, as shown most clearly in FIG. 16. The grooved regions 133 allow for a slot to be formed with the outer sleeve 140 when the two components 110 and 140 are coupled together, such that gases can move through the muzzle device 100 from a first end to a second end thereof. See FIG. 3, for purposes of illustration. In this manner, a vacuum may be created behind the gases during firing of a bullet.

In accordance with the disclosed concept, in one example embodiment the wall of the inner core 110 has a smaller thickness than the outer sleeve 140. In this manner, the inner core 110 can be configured with an outer diameter that allows the gas block 4 and the barrel nut to be slid over, and the outer sleeve 140, when coupled, can allow for durable dispersion of exhaust gases via its relatively thick wall. As stated above, this is not achievable with prior art firearms (not shown) that include muzzle devices, namely because they require relatively large thicknesses required for exhaust gas dispersion. The instant disclosed concept thus improves over these drawbacks, at least in that it allows for exhaust gas dispersion via the muzzle device 100 but also allows for cleaning additional components via de-coupling the outer sleeve 140 from the inner core 110.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

What is claimed is:

1. A muzzle device structured to be coupled to a barrel of a firearm, the muzzle device comprising:

an inner core structured to be coupled to the barrel; and an outer sleeve removably coupled to and disposed externally with respect to the inner core, wherein the inner core has an outer diameter that is less than an inside diameter of a gas block fitted to the barrel, and wherein the outer sleeve has an inside diameter that is less than 0.1 inches greater than the outer diameter of the inner core.

2. The muzzle device according to claim 1, wherein the inner core includes first threads to couple to the barrel and second threads to couple to the outer sleeve, wherein the first threads and second threads are reverse threaded.

3. The muzzle device according to claim 1, wherein the inner core has a first end and a second end disposed opposite and distal the first end, wherein the first end of the inner core is threaded for coupling the barrel, and wherein the second end of the inner core is threaded to be coupled to the outer sleeve.

4. The muzzle device according to claim 1, further comprising a set screw extending through the outer sleeve and into engagement with the inner core.

5. The muzzle device according to claim 4, wherein the inner core has a groove, and wherein the set screw cuts into the groove to minimize the set screw become dislodged from the inner core.

6. The muzzle device according to claim 1, wherein the inner core has a recessed groove about a thru hole extending through a wall of the inner core configured for a pin and welded coupling to the barrel.

7. The muzzle device according to claim 1, wherein each of the inner core and the outer sleeve has a plurality of ports to counteract recoil, and wherein the ports of the inner core and the ports of the outer sleeve are aligned with one another.

8. The muzzle device according to claim 1, wherein the inner core has a number of thru holes disposed on a top region thereof, and wherein the outer sleeve has a number of cutout regions each aligned with a corresponding one of the number of thru holes in order to minimize lift of the barrel during firing of the firearm.

9. The muzzle device according to claim 8, wherein the number of thru holes is less than four.

10. The muzzle device according to claim 1, wherein each of the inner core and the outer sleeve has a number of planar faces at a corresponding end thereof and being structured for gripping by a tool.

11. The muzzle device according to claim 1, wherein the inner core has a plurality of ports disposed between a first end and a second opposite and distal end of the inner core, wherein each of the ports are beveled, and wherein the beveling of the ports increases progressively from a first of the ports to a third of the ports.

12. A muzzle device structured to be coupled to a barrel of a firearm, the muzzle device comprising:

an inner core structured to be coupled to the barrel; and an outer sleeve removably coupled to and disposed externally with respect to the inner core, wherein the inner core has an outer diameter that is less than an inside diameter of a gas block fitted to the barrel, and wherein the inner core has a first end and a second end disposed opposite and distal the first end, wherein the first end of the inner core is threaded for coupling the barrel, and wherein the second end of the inner core is threaded to be coupled to the outer sleeve.

13. The muzzle device according to claim 12, wherein the inner core includes first threads to couple to the barrel and second threads to couple to the outer sleeve, wherein the first threads and second threads are reverse threaded.

14. The muzzle device according to claim 12, wherein the inner core has a recessed groove about a thru hole extending through a wall of the inner core configured for a pin and welded coupling to the barrel.

15. The muzzle device according to claim 12, wherein each of the inner core and the outer sleeve has a plurality of ports to counteract recoil, and wherein the ports of the inner core and the ports of the outer sleeve are aligned with one another.

16. The muzzle device according to claim 12, wherein the inner core has a number of thru holes disposed on a top region thereof, and wherein the outer sleeve has a number of cutout regions each aligned with a corresponding one of the number of thru holes in order to minimize lift of the barrel during firing of the firearm.

17. The muzzle device according to claim 16, wherein the number of thru holes is less than four.

18. The muzzle device according to claim 12, wherein each of the inner core and the outer sleeve has a number of planar faces at a corresponding end thereof and being structured for gripping by a tool.

19. The muzzle device according to claim 12, wherein the inner core has a plurality of ports disposed between a first end and a second opposite and distal end of the inner core, wherein each of the ports are beveled, and wherein the beveling of the ports increases progressively from a first of the ports to a third of the ports.

* * * * *